United States Patent [19]

Raubenheimer

[11] 4,434,519

[45] Mar. 6, 1984

[54] APPARATUS FOR CLEANING SUBMERGED SURFACES

[75] Inventor: Johann N. Raubenheimer, Bedfordview, South Africa

[73] Assignee: Peacock Investments (Proprietary) Limited, Johannesburg, South Africa

[21] Appl. No.: 306,616

[22] Filed: Sep. 28, 1981

[30] Foreign Application Priority Data

Sep. 30, 1980 [ZA] South Africa ..... 80/6049

[51] Int. Cl.[3] ..... E04H 3/20

[52] U.S. Cl. ..... 15/1.7

[58] Field of Search ..... 15/1.7, 340

[56] References Cited

U.S. PATENT DOCUMENTS 3,803,658 4/1974 Raubenheimer ..... 15/1.7

FOREIGN PATENT DOCUMENTS 2612043 9/1977 Fed. Rep. of Germany ..... 15/1.7

*Primary Examiner*—Edward L. Roberts

*Attorney, Agent, or Firm*—Sughrue, Mion, Zinn, Macpeak and Seas

[57] ABSTRACT

This invention relates to apparatus for cleaning submerged surfaces and particularly the surface of swimming pool walls and floors. The apparatus has a cleaning head comprising a shaft carrying a rotateable turbine in a housing. The apparatus has means associated with the turbine for causing the apparatus to move over the surface to be cleaned in a step by step manner. The invention also provides for the cleaning head to include means for automatically changing the operative position of the apparatus.

8 Claims, 6 Drawing Figures

APPARATUS FOR CLEANING SUBMERGED SURFACES

BACKGROUND TO THE INVENTION

THIS INVENTION relates to apparatus for cleaning submerged surfaces and particularly the surfaces of swimming pool walls and floors.

Apparatus of this type has been made and developed to move automatically across a surface to be cleaned by the action of suction filtration plant associated therewith. In swimming pools the suction plant is connected to surface cleaning apparatus through flexible hose and variation in the flow of water through the apparatus is utilized to impart stepwise movement to the apparatus across the surface being cleaned. In general the apparatus presently available often becomes ineffective when two surfaces such as a wall and floor meet at about right angles to each other. These devices cause a tendency to have variable flow through the apparatus and to submit various components to variable loads during use. Further the flexible hose has a great influence on the operation of the apparatus.

SUMMARY OF THE INVENTION

According to this invention there is provided apparatus for cleaning a submerged surface comprising:

(a) a housing;

(b) an outlet from the housing adapted to be connected to a suction hose which connects with a source of suction;

(c) an inlet to the housing arranged to face the submerged surface so that when suction is applied to the outlet the apparatus is biased towards the surface;

(d) a shaft mounted for rotation in the housing;

(e) a turbine having a series of blades mounted on the shaft adapted to be rotated by uninterrupted flow of liquid from the inlet to the outlet through the housing;

(f) carrying structure to which the shaft is journalled;

(g) at least one friction support mounted on the carrying structure for engaging the submerged surface; and (h) an inertial mass forming part of the apparatus energized by rotation of the turbine blades for generating reciprocating forces oblique to the surface and acting through each friction support in two opposed directions in turn, the force in a first direction tending to lift the friction support from the surface and the force in a second direction tending to push the friction support back on to the surface, the resultant of the second force and the bias caused by suction, causing the apparatus to advance over the surface in a step by step manner.

Many other important features of this invention will become apparent from the following description of examples of the invention suitable for use in domestic swimming pools. Reference is made in the description to the accompanying sketches in which:

DETAILED DESCRIPTION OF THE DRAWINGS

The first embodiment of the invention is described with reference to FIGS. 1 to 4.

Figure 1:
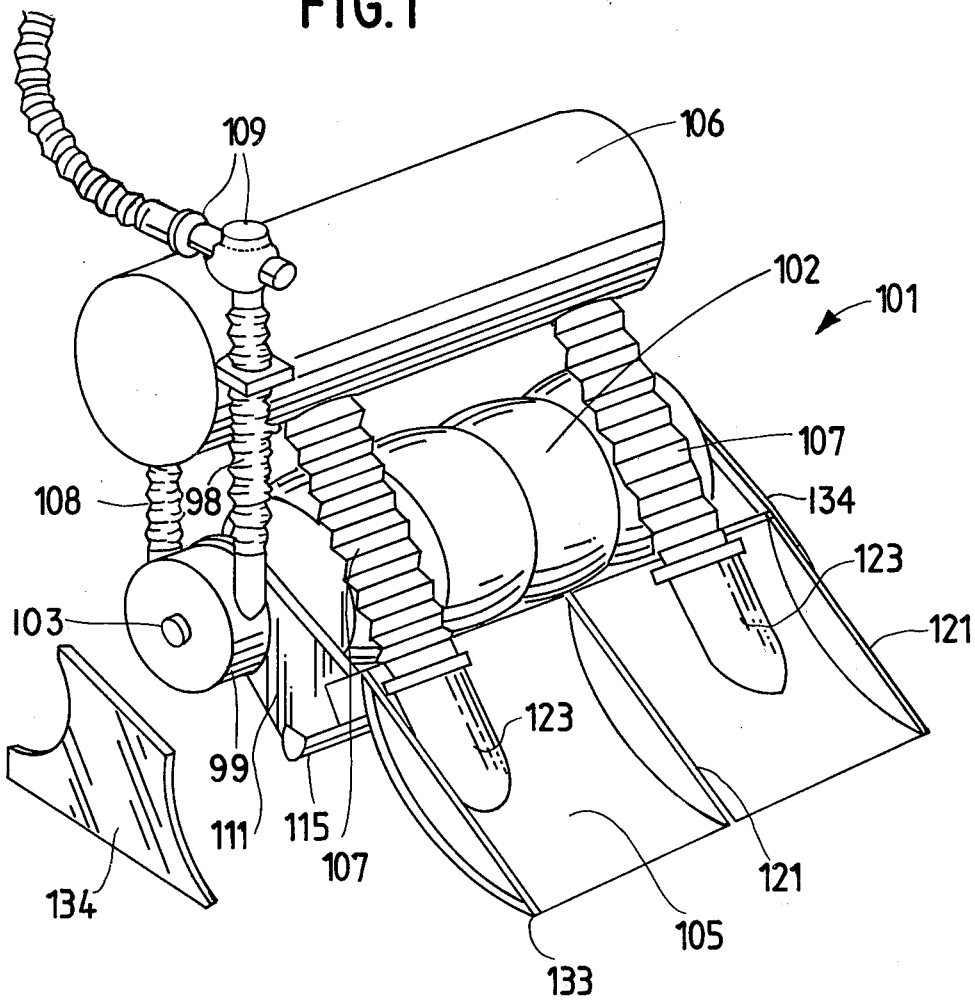
FIG. 1 is a diagrammatic oblique view of a first embodiment.

The apparatus 101 consists essentially as shown in FIG. 1 of a roller 102 mounted on a shaft 103 carrying a water turbine 104 in a casing 99 on one end. A cowl 105 projects rearwardly behind the roller 102 and supports and is in communication with a debris trap 106 through soft flexible pipes 107.

The debris trap is also connected through a suction pipe 108 to the turbine casing 99 and the outlet 98 from the turbine 104 is adapted for connection to the suction hose of a swimming pool filtration plant.

Figure 2:
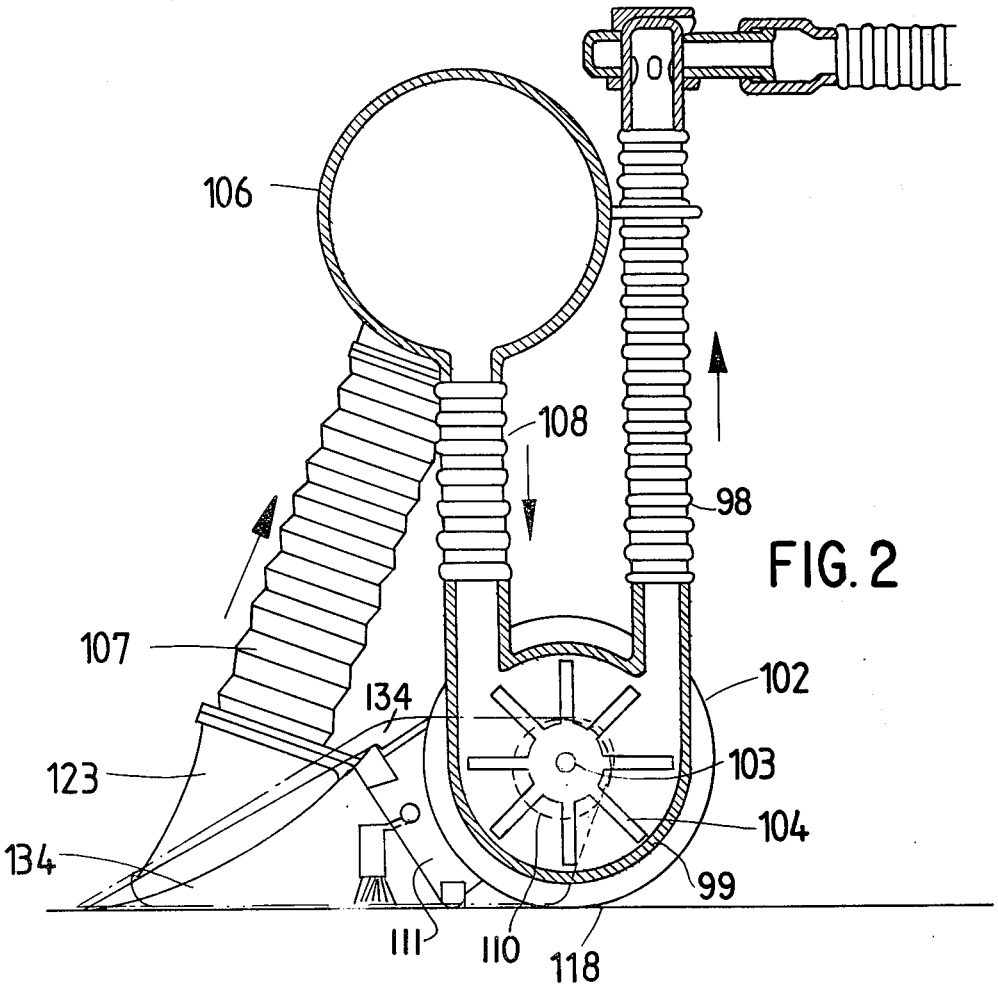
FIG. 2 is an end elevation of FIG. 1, partly in section, with one cover removed.

FIG. 2 shows the cowl 105 has end covers 134 supported on the shaft 103 on the far side and on the casing 104 on the near side and that the outlet to the filtration plant is made through pipe connections forming a universal coupling arrangement 109.

Figure 3:
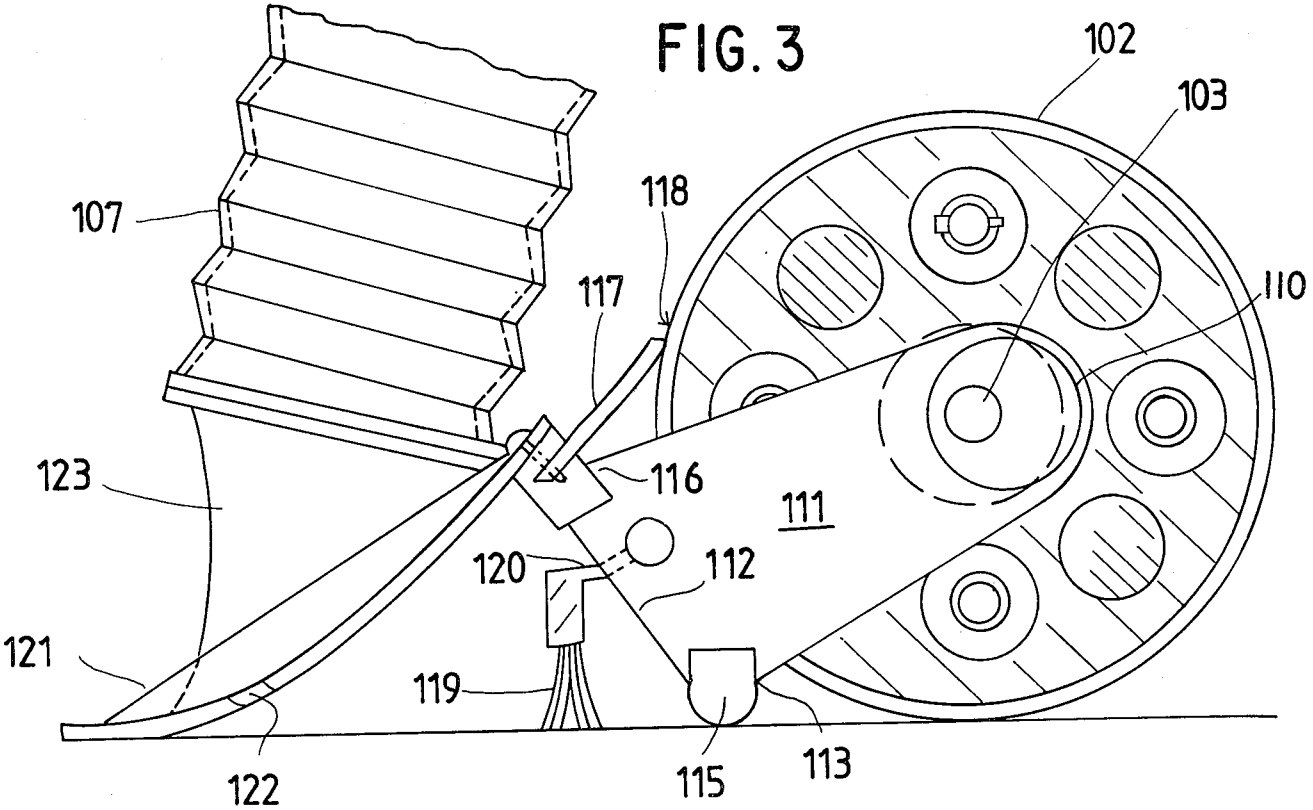
FIG. 3 is a section of part of FIG. 1 with parts of the apparatus removed.

The driving mechanism for the apparatus is illustrated in FIG. 3 (only one end being shown). The shaft 103 has secured thereto an eccentric cam 110 rotatably secured to the cam 110 is a driving member 111 in the form of a plate of roughly triangular shape. The apex of the triangle is secured to the cam 110 and the base 112 is located beyond the periphery of the roller 102.

One lower corner 113 of the plate is, in use, in contact with the surface 114 to be cleaned and is provided with a friction affording heel 115. The upper corner 116 has a pawl 117 projecting therefrom which engages the surface 118 of the roller 102. This pawl 117 is made to be flexible about its attachment to corner 116 but is substantially rigid along the length between the surface 118 of the roller 102 and the corner 116.

The driving members 111 carry between them a brush 119 adapted to contact the surface to be cleaned under the cowl 105 and the connection between the brush 119 and members 111 is through a flexible strip 120.

The cowl 105 itselt is made from suitable plastics material so that it is also sufficiently flexible relative to the driving members 111 to which it is secured adjacent corners 116 to enable it to operate as described below but is rigid enough to be self-supporting. Stiffening ribs 121 may be provided down the cowl 105 as illustrated at spaced intervals along the length thereof.

Openings 122 are provided along the cowl 105 for water flow therethrough.

Near each end of the cowl 105 there is a flexible coupling piece 123 for connection of the pipes 107 opening at their other ends into the debris trap 106.

Figure 4:
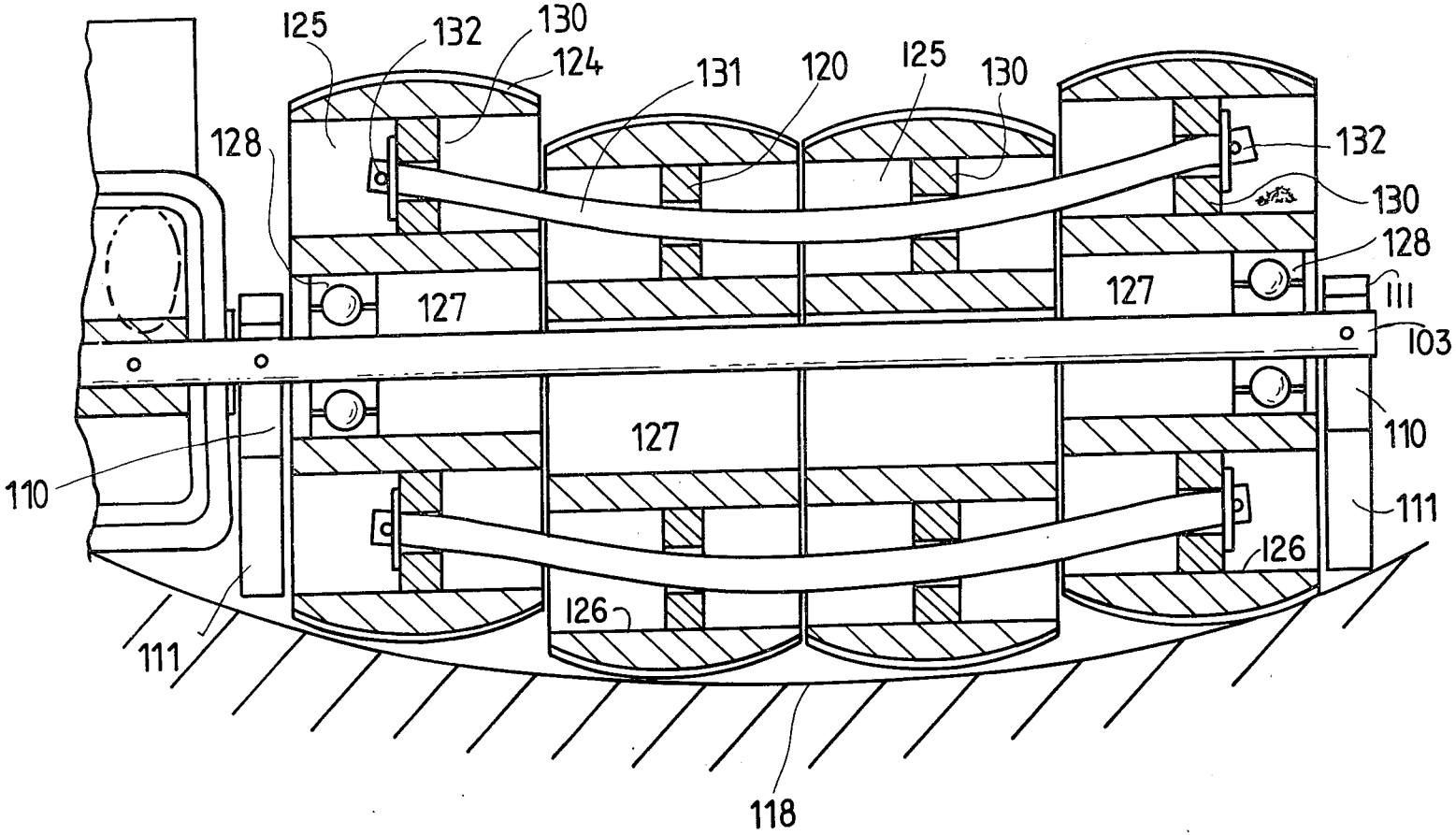
FIG. 4 is a longitudinal section through part of FIG. 1.

Referring particularly to FIG. 4 it will be seen that the roller 102 is a member comprising a series of rollers mounted in juxtaposition on the shaft 103. The roller 102 is constructed in such a manner that its overall specific gravity is somewhat heavier than that of water.

The rollers have covers 124 with the majority of the internal space filled with foamed synthetic resin such as polystyrene indicated at 125. Weights 126 are included in the mass of the material to obtain the desired overall specific gravity. Axial passages 127 are provided through the rollers to accommodate the shaft 103 and the end rollers are provided symmetrically located around the axial passages and each has a support 130 for a flexible connecting element 131 threaded through the supports and secured at its ends by washers and pins or the like indicated at 132. This arrangement enables the composite rollers 102 to flex transverse to the length of the shaft 103 as indicated in FIG. 4.

In use the apparatus is placed in the swimming pool to be cleaned and connected through the flexible suction hosing to the normal filtration plant. The apparatus automatically rests on the roller and trailing edge 133 of the cowl 105. This is ensured by the choice of the materials from which the apparatus components are made and their relative locations. To assist in the apparatus maintaining its proper attitude during use the debris trap will include a suitable float arrangement.

When the filtration plant is operated water is drawn continuously through the openings 122 into the cowl 105 and thence through pipes 107 debris trap 106 to the turbine 104 and then leaving the apparatus through the universal coupling arrangement 119 to the filtration plant.

The flow of water operates the turbine 104 with consequent continual rotation of the shaft 103. This carries with it the cam 110 which in turn moves the driving members 111 and in particular the heels 115 and the rollers engaging pawls 117. The relative positions of the cam 110, heels 115 and pawls 117 can be determined to ensure that the movement caused by rotation of the cam 110 induces a stepwise thrust to roller 102 to cause it to rotate and move in the direction of arrow "A". This induced thrust will be effected alternately through the frictional engagement of the heels 115 with the surface to be cleaned and the pawl on the roller surface for each rotation of the shaft 103.

The speed of movement and amount of thrust can be determined by the particular design of the components for the apparatus and can be chosen to suit particular requirements.

The flow of water under the cowl 105 through openings 122 and out through pipes 107 causes a swirling action of the water. This, together with the action of the brush 119 on the surface 118, tends to lift dirt and debris from the floor and allow it transportation to debris 106 and filtration plant.

The operation of the apparatus above described has been found to enable it to move continuously across a surface and to change direction to move across a surface at right angles thereto. Thus if the apparatus is moving across the floor of a swimming pool in the manner above described and contacts a vertical wall the roller 102 will move up the wall under the influence of the thrusts imparted through the driving members 111. This effect is ensured due to the flexibility of the cowl 105 and the relative rotatability of the end covers 134. The suction from the filtration plant holds the apparatus against the surface being cleaned and through its transition from one filtration plant holds the apparatus against the surface being cleaned and through its transition from one surface to another at right angles thereto.

Because the roller 102 is made flexible transversely to the shaft 103 the apparatus will also continue to operate when only part of the roller encounters an obstruction to its movement. Such a situation frequently occurs when a swimming pool has built in steps and the apparatus contacts a corner of a step. The flexibility of the roller enables the apparatus under the thrust applied thereto to assume a position whereby the obstruction will not prevent continued movement of the apparatus.

It will be appreciated that the apparatus can be made in the main from inexpensive materials which can resist the effects of swimming pool water and the additives thereto. Further the machine operates on a continuous flow of water therethrough which is unlikely to impart any adverse stress on the filtration plant.

Figure 5:
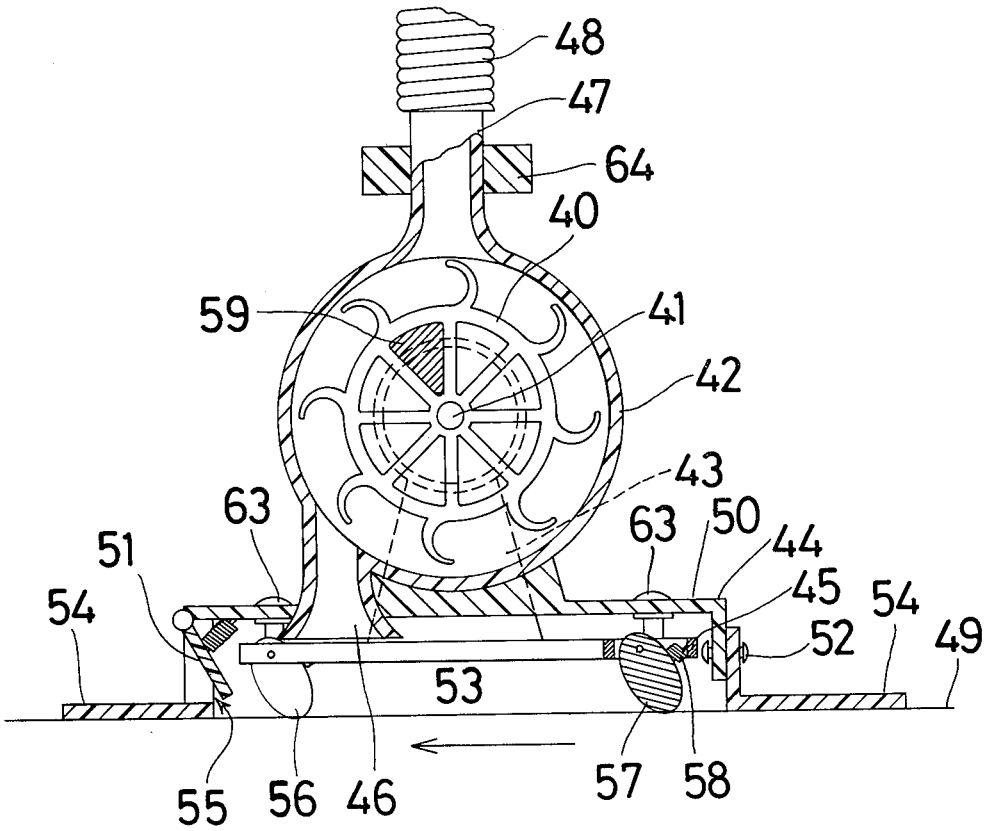
FIG. 5 is a side sectional elevation of a second embodiment.

Referring now to FIG. 5, a second embodiment is shown which comprises a turbine 40 rotatably mounted on a fixed shaft 41. The shaft 41 passes through the walls of a turbine housing 42 and is supported on supports 43. The supports 43 extend downwards towards a cleaning head 44 and are rigidly mounted on a frame 45 which comprises the structure for the cleaning head 44. The turbine housing 42 has an inlet 46 located in the cleaning head and an outlet 47 adapted to be coupled to a suction hose 48 in use. Liquid flow in the uninterrupted passageway between inlet 46 and the outlet 47 causes the turbine to rotate in known manner.

The cleaning head of this embodiment comprises a chamber formed by the support surface 49, an upper flexible planar member 50, front section 51, rear section 52 and side sections 53. The front rear and side sections 51, 52 and 53 are moveable relative to the frame 45 in order that the apparatus is able to negotiate uneven surfaces. The front rear and side sections each have flexible flaps 54 attached to the lower edges thereof to improve the sealing characteristics of the cleaning head with the support surface 49.

The front section 51 includes a gap 55 therein to allow water into the cleaning head as well as leaves and other swimming pool debris.

The apparatus is supported off the surface 49 by means of front and rear fast numbered 56 and 57 respectively. The feet are pivotally mounted on the support frame 45, the front feet 56 mounted forward of the shaft 41 and the back feed 57 mounted rearwardly thereof. The feet extend backwardly and downwardly preferably at an angle of between 45° and 60° to the support surface 49. The feet have a limited oscillatory movement about their pivots and include biasing means 38 which biases then in a downward position. The feet are thus moveable between two positions, the free ends having a distance of travel of a few millimeters.

The turbine 40 includes an eccentric mass 59 thereon. The eccentric mass has sufficient mass to cause the apparatus to rock between the front feet 56 and the back feet 57 during rotation of the turbine. As the apparatus rocks off the one foot the biasing means urges that foot into its downward position. As the apparatus rocks onto that foot the reaction of the apparatus onto that foot pivots the foot to its upper position thereby causing the apparatus to move across the surface in a step by step manner.

Figure 6:
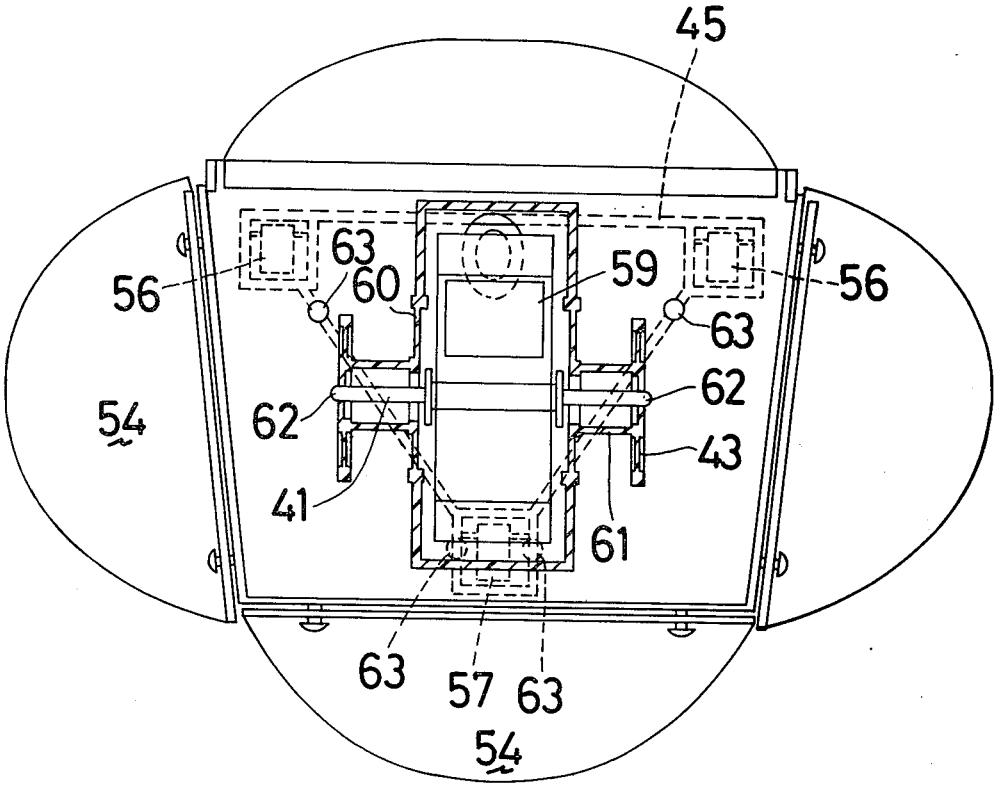
FIG. 6 is a plan view partly to section of FIG. 5.

The turbine apparatus can more clearly be seen in FIG. 6. The turbine shaft 41 extends through the housing wall 60 through tubular members 61 to the supports 43. The point of attachment to the supports is formed from a flexible material such as flexible poly-urethane. The housing wall 60 and tubular members 61 are also manufactured from a flexible material. The ends of the shaft are captively held in cups 62 at the ends of the tubular members. The upper planar member 50 is also manufactured from a flexible material The upper planar member 50 is only connected to the support frame 45 at a few points indicated by numeral 63, so that the member 50 acts as a spring suspension for the frame 45.

The apparatus is provided with buoyancy compensating floats 64 to ensure that the centre of buoyancy is slightly above the centre of gravity. If the apparatus falls freely in water, it will automatically land with its cleaning head in contact with the support surface in the operative condition.

It will be obvious to one skilled in the art that the support means for the turbine and the means for transferring the vibrations to the frame can vary considerably as can the configuration of the cleaning head. Any apparatus however which is caused to move over the surface by means of pivoting feet as hereindescribed will fall within the scope of the invention.

Many modifications can be made to the particular configurations of components above described without departing from the scope of the invention.

What I claim as new and desired to secure by Letters Patent is:

1. Apparatus for cleaning a submerged surface (118) comprising:

(a) a housing (99);

(b) an outlet (98) from the housing adapted to be connected to a suction box (109) which connects with a source of section;

(c) an inlet (123) to the housing arranged to face the submerged surface so that when suction is applied to the outlet the apparatus is biased towards the surface;

(d) a shaft (103) journalled for rotation in the housing;

(e) a turbine having a series of blades (104) mounted on the shaft adapted to be rotated by uninterrupted flow of liquid from the inlet to the outlet through the housing;

(f) carrying structure (111) separate from the housing;

(g) at least one friction support (115) mounted on the carrying structure for engaging the submerged surface; and (h) means (110) connecting the shaft to the carrying structure to cause the carrying structure to reciprocate relative to the housing to thereby generate reciprocating forces oblique to the surface and alternately acting through the friction support in two opposed directions, the force in a first direction tending to lift the friction support from the surface and the force in a second direction tending to push the friction support back onto the surface, the resulting effect of said oblique forces and the bias caused by suction causing the apparatus to advance over the surface in a step by step manner.

2. Apparatus for cleaning a submerged surface as claimed in claim 20 in which the shaft carries a surface engaging roller and wherein the connecting means comprises an eccentric cam on each end of the shaft, wherein a driving member comprising the carrying structure is rotatably mounted on each cam to project beyond the periphery of the roller, wherein the friction support comprises a floor engaging heel at a free end of the driving member, and wherein a cowl enabling liquid to be drawn from the surface to be cleaned is mounted adjacent the roller and housing.

3. Apparatus for cleaning a submerged surface as claimed in claim 2 in which the driving member carries a surface engaging brush located within the cowl.

4. Apparatus for cleaning a submerged surface as claimed in claim 3 in which the roller is formed as a flexible element comprising separate rollers mounted in juxtaposition on the shaft.

5. Apparatus for cleaning a submerged surface (49) comprising:

(a) a housing (42);

(b) an outlet (47) from the housing adapted to be connected to a suction hose (48) which connects with a source of suction;

(c) an inlet (46) to the housing arranged to face the submerged surface so that when suction is applied to the outlet the apparatus is biased towards the surface;

(d) a shaft (41) disposed for rotation in the housing;

(e) a turbine (40) having a series of blades mounted on the shaft adapted to be rotated by uninterrupted flow of liquid from the inlet to the outlet through the housing;

(f) carrying structure (45) to which the shaft is journalled;

(g) at least one friction support (56 or 57) mounted on the carrying structure for engaging the submerged surface; and (h) an eccentric weight (59) carried by the shaft for generating reciprocating forces on the carrying structure oblique to the surface and alternately acting through the friction support in two opposed directions, the force in a first direction tending to lift the friction support from the surface and the force in a second direction tending to push the friction support back onto the surface, the resulting effect of said oblique forces and the bias caused by suction causing the apparatus to advance over the surface in a step by step manner.

6. Apparatus as claimed in claim 5, in which the friction support is a pivotally mounted foot projecting at an angle to the submerged surface and being biased towards the vertical to said surface.

7. Apparatus as claimed in claim 5, in which there are at least two friction supports comprising a pair of feet individually disposed on opposite sides of the shaft.

8. Apparatus as claimed in claim 5, in which there are at least three friction supports comprising a pair of feet on one side of the shaft and one foot on the other side of the shaft.

* * * * *